US005173931A

United States Patent [19]

Pond

[11] Patent Number: 5,173,931

[45] Date of Patent: Dec. 22, 1992

[54] HIGH-INTENSITY X-RAY SOURCE WITH VARIABLE COOLING

[76] Inventor: Norman Pond, 11635 Jessica La., Los Altos Hills, Calif. 94024

[21] Appl. No.: 787,258

[22] Filed: Nov. 4, 1991

[51] Int. Cl.[5] ..... H01J 35/24

[52] U.S. Cl. ..... 378/130; 378/127; 378/142

[58] Field of Search ..... 378/142, 125, 127, 130

[56] References Cited

U.S. PATENT DOCUMENTS

| | | |
|---|---|---|
| 2,111,412 | 3/1938 | Ungelenk . |
| 2,493,606 | 1/1950 | Waterton . |
| 2,549,614 | 4/1951 | Leighton . |
| 2,679,608 | 5/1954 | Cordingly . |
| 3,018,398 | 1/1962 | Atlee . |
| 3,405,310 | 10/1968 | Rado . |
| 3,646,380 | 2/1972 | Hartl . |
| 3,735,175 | 5/1973 | Blomgren, Jr. . |
| 3,801,846 | 4/1974 | Haberrecker . |
| 3,942,015 | 3/1976 | Huxley . |
| 3,942,059 | 5/1976 | Tran-Quang . |
| 4,024,424 | 5/1977 | Eggelsmann et al. . |
| 4,128,781 | 12/1978 | Flisikowski et al. . |
| 4,144,471 | 3/1979 | Hartl . |
| 4,161,671 | 7/1979 | Klinkert . |
| 4,300,051 | 11/1981 | Little . |
| 4,788,705 | 11/1988 | Anderson . |
| 4,821,305 | 4/1989 | Anderson . |
| 4,916,015 | 4/1990 | Schaffner et al. . |
| 4,943,989 | 7/1990 | Lounsberry et al. . |
| 4,964,148 | 10/1990 | Klostermann et al. . |

FOREIGN PATENT DOCUMENTS

| | | |
|---|---|---|
| 701893 | 1/1954 | United Kingdom . |

*Primary Examiner*—Craig E. Church
*Attorney, Agent, or Firm*—Limbach & Limbach

[57] ABSTRACT

The present invention is directed to a method and apparatus for generating x-rays employing a vacuum x-ray tube wherein the entire tube housing containing an x-ray emitting anode and an electron emitting cathode is rotated about an axis with means for focussing electrons from the cathode onto a region of the anode. Heat is conducted from the anode to an extended cooling surface remote from the anode by varied heat conduction tailored to produce a substantially uniform temperature over the cooling surface.

20 Claims, 2 Drawing Sheets

HIGH-INTENSITY X-RAY SOURCE WITH VARIABLE COOLING

The present invention relates to method and apparatus for generating high-intensity x-rays.

In the past, x-ray tubes have been described with anodes which spin to distribute the heat and in which the heat is removed by radiation. Other x-ray tubes have been described with a fluid cooled anode firmly attached to the vacuum envelope and with the vacuum envelope rotated. The major shortcoming of these devices has been the ability effectively to cool the anode which is heated to temperatures in excess of 2000° C. Since the x-ray tube is a pulsed device, conventional liquid cooling is unsatisfacory because the energy level during the pulsed "on" period is too high to be removed. Thus, the need exists for energy storage and high temperature capability of radiation cooled designs combined with a liquid cooling system compatible with the high temperature anode using a variable temperature conductor to insure against exceeding the maximum temperature permissible for effective fluid cooling and other techniques for cooling different parts of the x-ray tube.

Broadly stated, the present invention is directed to method and apparatus for generating x-rays where the entirety of the x-ray vacuum tube housing containing an anode is rotated about an axis with means for focusing electrons onto a region of the anode off the axis and with an extended cooling surface which is remote from the anode and to which heat from the anode is conducted by variable heat conduction to produce a substantial uniform temperature over the cooling surface.

With this invention, it is possible to achieve the necessary heat distribution for efficient heat exchange operation while keeping the cooling liquid at a safe temperature.

In accordance with another aspect of the present invention, method and apparatus are provided for generating and focusing electrons onto a region of the anode off the axis and maintaining relative movement between that region and the anode when the housing is rotated. This generating means can take the form of a cathode which is stationary or of deflecting means such as a magnetic field for deflecting a beam of electrons onto the desired region of the anode.

In accordance with one aspect of the present invention each one of a series of separate regions transfers substantially the same amount of heat to the cooling surface even though the path to the various regions o f the heat exchanger varies significantly.

In accordance with another aspect of the present invention, an envelope is provided containing the housing to control the temperature of the housing itself. This aspect of the present invention can be achieved by maintaining at least a partial vacuum between the housing and the envelope and/or including means for circulating a cooling fluid through the space between the housing and the envelope.

Another aspect of the present invention in keeping with the last aforementioned aspect, is the use of a cooling fluid which is semi-transparent to energy emerging from the housing other than emerging x-rays thereby spreading out the heat absorption over a greater volume of cooling fluid for better heat exchange to achieve a lower temperature vacuum envelope.

These features and advantages of the present invention will become more apparent upon a perusal of the following specification taken in conjunction with the accompanying drawings in which similar reference of characters refer to similar elements in each of the several views.

DESCRIPTION OF THE PREFERRED EMBODIMENT

Figure 1:
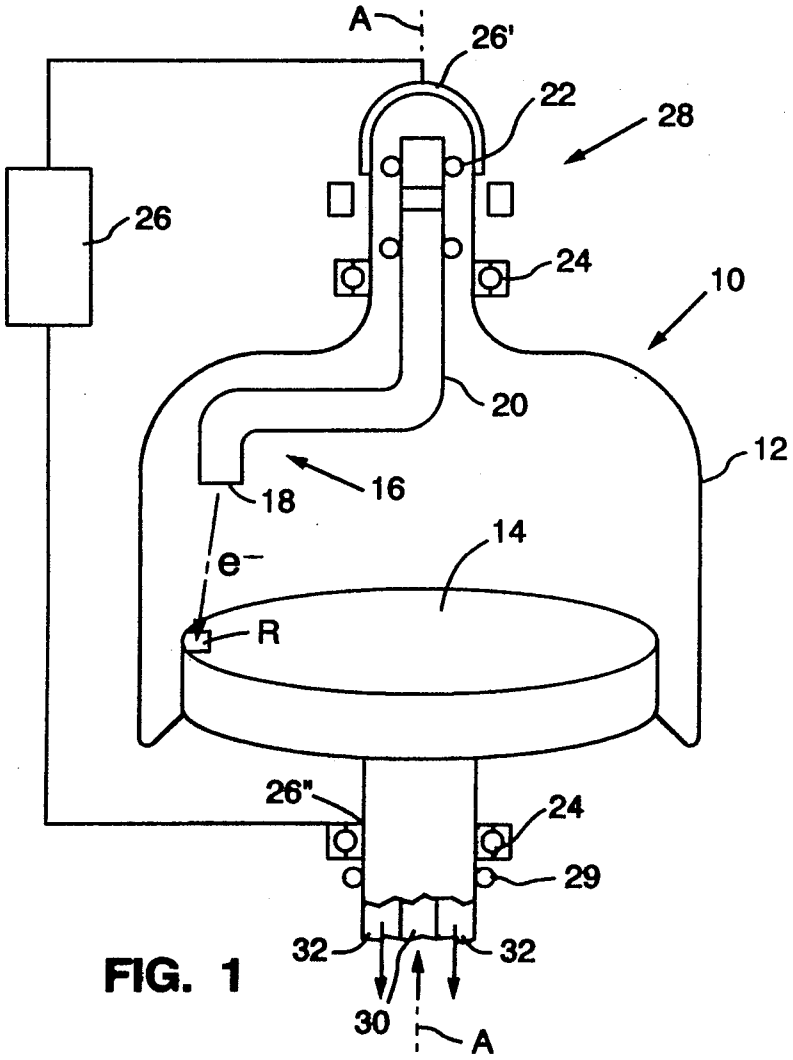
FIG. 1 is a schematic elevational, partially perspective view of an x-ray tube embodying the present invention.
Figure 2:
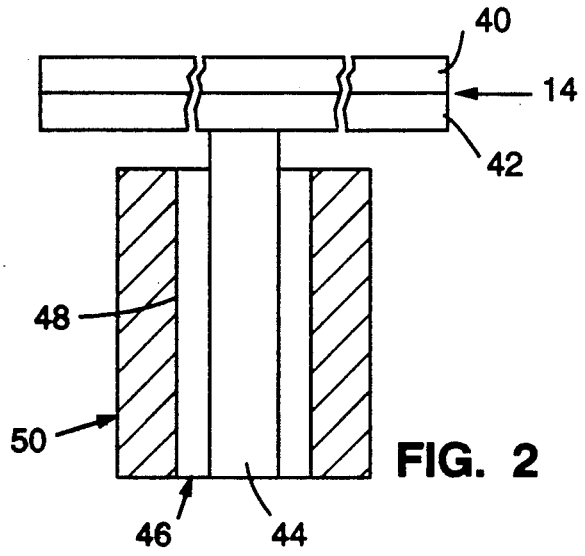
FIG. 2 is an elevational schematic view, partially in section, of the heat exchanger for cooling the anode as shown in FIG. 1.
Figure 3A:
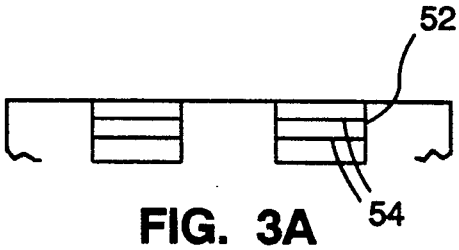
FIG. 3A is an elevational view showing one embodiment of the construction of a portion of the structure illustrated in FIG. 3.
Figure 3:
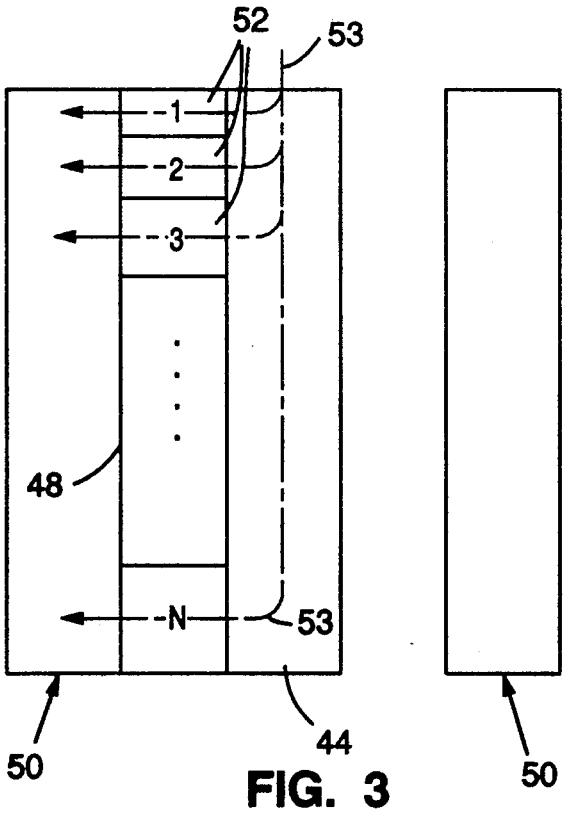
FIG. 3 is an enlarged schematic elevational view of portion of the structure shown in FIG. 2.

While it will be appreciated from the alternative embodiments described below that the present invention can be accomplished utilizing different structures and techniques and the invention applies to other devices requiring cooling of certain parts, the preferred embodiment of the present invention is directed to a high-intensity x-ray tube as illustrated in FIGS. 1–3.

Referring now to FIGS. 1–3, there is shown an x-ray tube 10 having an evacuated housing or chamber 12 within which a circular anode structure 14 is mounted for receiving electrons from a cathode assembly 16. In the preferred embodiment the cathode assembly 16 includes a thermionic cathode 18 mounted on a support structure 20 positioned on a rotatable support 22 within the housing 12. The entire housing 12 is rotated about tube axis A on bearings 24 by a drive mechanism not shown. A high voltage source 26 is connected across the end walls 26' and 26''. The cathode 18 can be heated using transformer coupled or slip ring coupled means for providing power to the cathode heater.

While the housing 12 is rotated, the cathode assembly 16 can be held stationary such as by a magnetic coupling assembly 28 so that the point of contact between the electron beam and the anode is fixed in space unless the entire tube assembly is moving. A beam of x-rays is generated and directed through the housing in well known manner for transmission and utilization at another location.

A fluid cooling medium such as coolanol, a fluorocarbon, or distilled water can be directed via lines 30 and 32 and a rotating liquid seal 29 to and from a heat exchanger for efficiently cooling the anode as described in greater detail below.

Referring now to FIG. 2, the anode 14 is made up of a segment 40 such as of carbon to withstand the operating temperature of over 2000° C. The anode 14 is mounted on a high temperature disk 42 with an axial support cylinder or stem 44 all made of a solid high heat conducting material as of molybdenum for conducting heat away from the anode 14. A variable thermal conductor assembly 46 conducts heat from the stem 44 to a remote cooling surface 48 of a heat exchanger 50 in which the cooling fluid is circulated and exhausted.

In the preferred embodiment of the variable thermal conductor 46 shown in FIG. 3, a series of thermally insulated regions or segments 52, denoted as 1, 2, 3, . . . n surround the anode support stem 44 and conduct heat radially from the support stem 44 to the cooling surface 48 of the heat exchanger 50. The construction of the segments or regions 52 is selected so that each segment or region 52 will achieve approximately equal heat transfer from the stem 44 to the cooling surface 48 even though the temperature of the stem 44 at the radially inward end of the different segments 52 in the series varies greatly starting from a maximum of about 2000° C. at the beginning of the series. The direction of transfer is shown by line 53.

In region 1 the heat transfer is poor with a temperature drop of about 1900° C. The heat transfer characteristics of each succeeding region or segment 52 in the series increases. Control of the heat transfer in the different segments or regions is achieved in different ways. As illustrated in FIG. 3A, heat transferred in each region or segment 52 is accomplished using thin disks 54 and the number of disks 54 and the thickness of the disks 54 in each separate segment or region 52 are altered to achieve the desired heat transfer at the different locations along the series.

Figure 3B:
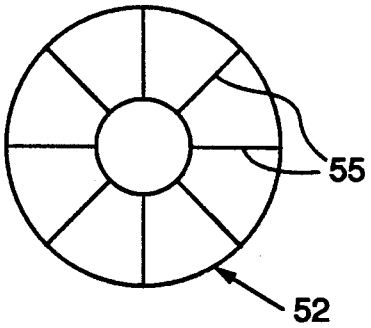
FIG. 3B is a plan view showing another alternative embodiment of the construction of the structure shown in FIG. 3.

Alternatively, as shown in FIG. 3B, the bulk of the heat is conducted via radial webs 55 and the number and thickness of webs 55 used in the segments or regions 52 increase in the sequential segments or regions 52 in the series so as to achieve approximately equal heat transfer with each segment or region 52 even though the temperature of the stem 44 at the radial inward portion of the segments or regions 52 varies beginning with a very high temperature at the beginning of the series.

In addition to changing the number and thickness of the disks 54 and webs 56, the material from which these elements are made can be changed to alter the heat transfer characteristics.

The volume of material in each segment is approximately inversely proportional to the temperature drop; i.e., the section 52 where a 1900° drop is required will contain 1/19 the amount of material for the section where 100° is required. An alternative is to use materials with different thermal conductivity.

The cooling system of this invention permits anode operation at very high temperatures with an anode structure of sufficient thermal mass for pulsed operation and with a liquid cooling system augmenting radiation cooling thereby providing a major increase in the average power dissipated by the anode.

Figure 4:
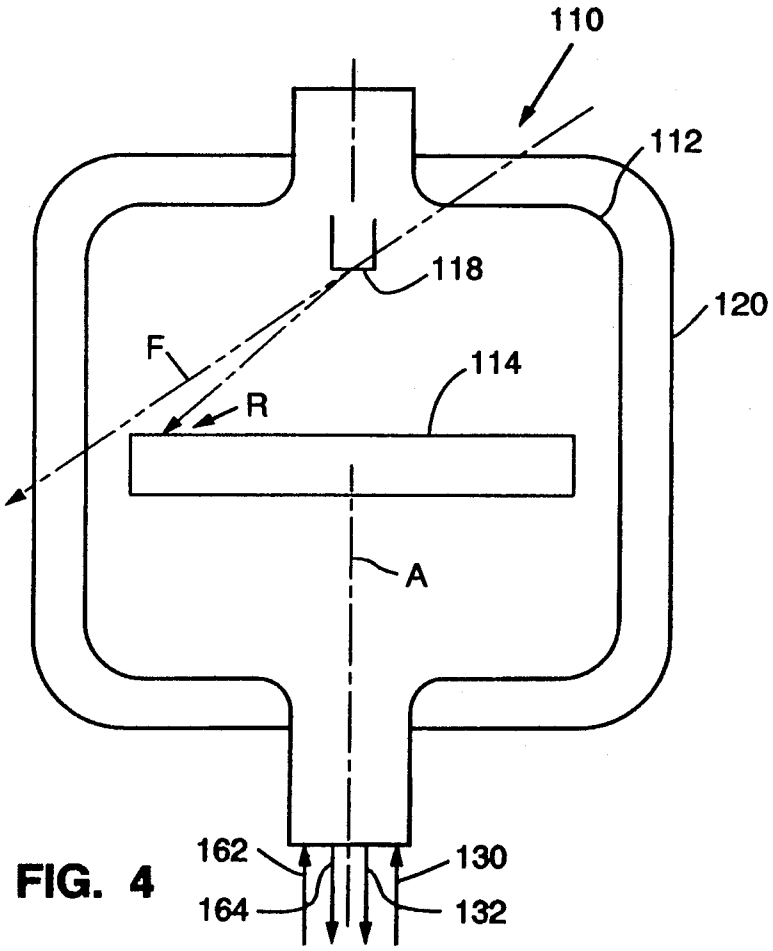
FIG. 4 is a schematic elevational sectional view illustrating another embodiment of the present invention.

Another embodiment of the present invention is shown in FIG. 4 in which a stationary cathode 118 is fixedly mounted on the axis A of the x-ray tube 110, and a magnetic field F is applied by coils (not shown) for deflecting the electron beam from the cathode 118 to the radially outwardly located region R on the anode 114 and maintaining an x-ray emission spot fixed in space. The cooling fluid to the heat exchanger to cool the anode passes through lines 130 and 132.

In the embodiment shown in FIG. 4, a sealed envelope 120 is provided completely surrounding the housing 112 to cool the housing 112 and thus the x-ray tube 110. For certain applications the space 122 between the housing 112 and the sealed envelope 120 is evacuated so that the friction between the housing 112 and the surrounding environment is not so high as to heat the housing 112 and stress the housing 112 beyond a safe limit.

Under other conditions, a cooling fluid is circulated through space 122 between housing 112 and the sealed surrounding envelope 120 being fed to the space by line 162 and from the space by line 164. The fluid is provided to be semi-transparent to energy emerging from the housing 112 other than the emerging x-rays thereby spreading out the heat absorption by the cooling fluid over a greater volume of cooling fluid for better heat exchange to achieve a lower temperature vacuum envelope. The control of the transparency to the emerging energy can be by the color, viscosity and thermal conductivity of the constituents of the cooling fluid.

In certain applications the sealed envelope 120 can be made of metal and in which a window such as of ceramic is provided for passing the x-rays therethrough.

While the preferred apparatus and method have been described, other embodiments which achieve the same function as recognized by those skilled in the art are intended to be encompassed in the appended claims.

I claim:

1. An x-ray source comprising:

a housing forming a vacuum chamber, the entirety of the housing rotatable about an axis, a portion of said housing being an anode, means for rotating said housing about said axis, means mounted within said chamber for generating electrons, means for focusing electrons at a point in space off said axis, an extended cooling surface remote from said anode, means for providing variable heat conduction from said anode to said extended coo ling surface to produce a substantially uniform temperature over said cooling surface, and means for cooling said cooling surface.

2. The x-ray source of claim 1 wherein said generating means and said focusing means includes a cathode positioned off said axis and means for maintaining said cathode stationary when said housing is rotating about said axis.

3. The x-ray source of claim 1 wherein said generating means and said focusing means includes a cathode positioned on said axis and means for deflecting the electron beam from said cathode to said point in space.

4. The x-ray source of claim 1 wherein said cooling means includes means for conveying a fluid to said cooling surface.

5. The x-ray source of claim 1 wherein said cooling means includes means for conveying a fluid to said cooling surface and said housing.

6. The x-ray source of claim 1 including an envelope containing said housing to control the temperature of said housing.

7. The x-ray source of claim 6 including means for maintaining at least a partial vacuum between said housing and said envelope.

8. The x-ray source of claim 6 including means for circulating a cooling fluid through the space between said housing and said envelope.

9. The x-ray source of claim 8 wherein said cooling fluid is semitransparent to energy emerging from said housing other than emerging x-rays.

10. Apparatus for generating high intensity radiation comprising:

an evacuated housing, means for directing electrons from a cathode to a point in the space within said housing for impingement on an anode inside said housing, means for rotating said housing and said anode relative to said point in space in said housing, means for conducting heat from said anode through an elongate conductor, means for transferring substantially equal amounts of heat from different locations along the length of said elongate conductor to a cooling surface, means for directing a cooling fluid over said cooling surface to cool said cooling surface and thus said anode.

11. An x-ray source comprising:

an evacuated housing having a rotational axis, an anode coaxially mounted within said housing on said housing axis, a cathode assembly for directing a beam of electrons onto a point in the space in said housing which point is intercepted by said anode, means for rotating said housing for producing x-rays from different parts of said anode, an elongate heat conductor connected to said anode for conducting heat from said anode, a cooling surface, means for conducting substantially equal amounts of heat to said cooling surface from a plurality of locations on said heat conductor for producing a substantially uniform temperature over said cooling surface and means for directing a cooling fluid over said cooling surface to cool said anode.

12. The x-ray source of claim 11 wherein said anode is fixedly mounted in and rotational with said housing.

13. The x-ray source of claim 11 wherein said cathode assembly includes a cathode positioned off said axis and means for maintaining said cathode stationary when said housing is rotating about said axis.

14. The x-ray source of claim 11 wherein said cathode assembly includes a cathode positioned on said axis and means for deflecting the electron beam from said cathode to said point.

15. The x-ray source of claim 11 including a envelope surrounding said housing.

16. The x-ray source of claim 15 including a cooling fluid circulating through the space between said housing and said envelope, said cooling fluid being semitransparent to energy emerging from said housing other than said x-rays.

17. The method of generating high intensity radiation comprising the steps of:

directing electrons from a cathode to a point in the space located inside a housing and intercepted by an anode, rotating said housing and said anode to generate x-rays, conducting heat from said anode through an elongate conductor, transferring substantially equal amounts of heat from different locations along the length of said elongate conductor to a cooling surface, directing a cooling fluid over said cooling surface to cool said cooling surface and thus said anode.

18. The method of claim 17 including the step of directing over said housing a cooling fluid semitransparent to energy emerging from said housing other than said high intensity radiation.

19. The method of generating x-rays comprising the steps of:

directing electrons from a cathode to a point located in the space within a housing and intercepted by an anode, rotating said housing and said anode about the axis of said housing to produce x-rays from said anode, providing variable heat conduction from said anode to an extended cooling surface remote from said anode to produce a substantially uniform temperature over said cooling surface, and cooling said extended cooling surface to cool said anode.

20. The method of claim 19 wherein said step of providing variable heat conduction includes the steps of:

conducting heat from said anode through an elongate conductor and transferring substantially equal amounts of heat from different locations along the length of said elongate conductor to said cooling surface.

* * * * *